United States Patent [19]

Murahashi et al.

[11] Patent Number: 4,481,898

[45] Date of Patent: Nov. 13, 1984

[54] SLURRY CARRYING SHIP

[75] Inventors: Tatsuya Murahashi, Sennan; Yasuo Nakai, Osaka; Kazuyoshi Hosogaya, Nabari, all of Japan

[73] Assignee: Hitachi Shipbuilding & Engineering Co., Ltd., Osaka, Japan

[21] Appl. No.: 374,242

[22] Filed: May 3, 1982

[30] Foreign Application Priority Data

May 7, 1981 [JP] Japan ..... 56-66460
May 7, 1981 [JP] Japan ..... 56-66461
May 7, 1981 [JP] Japan ..... 56-66462

[51] Int. Cl.[3] ..... B63B 25/08
[52] U.S. Cl. ..... 114/74 R; 414/140
[58] Field of Search ..... 114/74 R, 73, 27; 210/321.1, 172, 447, 416.1, 238; 414/140

[56] References Cited

U.S. PATENT DOCUMENTS 1,793,080 2/1931 Glover ..... 210/238
3,935,105 1/1976 McEwen ..... 210/416.1

FOREIGN PATENT DOCUMENTS 111729 9/1968 Denmark ..... 114/74 R
53-83289 7/1978 Japan ..... 114/74 R
1380535 1/1975 United Kingdom .

*Primary Examiner*—Trygve M. Blix
*Assistant Examiner*—Thomas J. Brahan
*Attorney, Agent, or Firm*—Barnes, Kisselle, Raisch, Choate, Whittemore & Hulbert

[57] ABSTRACT

A slurry carrying ship is characterized by hollow drainage posts provided in each cargo hold beneath the hatch at locations close thereto. Water passages are formed in the interior space of each post which is provided on its side walls with vertical rows of drainage ports and filters attached to the respective ports. Slurry water passes the drainage ports and the water passages and discharges through drain pipes provided at the lower end of the post. These drainage posts, because of their locations, can effectively drain water from coal slurry while reliably supporting the upper structures.

9 Claims, 12 Drawing Figures

SLURRY CARRYING SHIP

The present invention relates to a slurry carrying ship, and more particularly to a ship for carrying coal slurry which is provided with means for effectively draining slurry water.

In case of transporting a powdery or granular material such as iron sand, powdery ore, chips, coal and gravel by a carrier ship, the material is converted to slurry and fed through pipelines into the cargo holds of the ship for readier loading. However, coexistent slurry water reduces the amount of material loaded and adds to the weight of the ship, hence uneconomical when transporting. Thus it is necessary to effectively drain slurry water after loading.

For this purpose, a ship is already known in which each hold is provided with drainage means on the bottom and side walls of the hull. These drainage means drain slurry water by the spontaneous fall of the water due to gravity. However because of their locations at the periphery of the cargo slurry (at the inner peripheral surfaces of the hull), the drainage means are unable to sufficiently drain the slurry water.

It is therefore an object of the present invention to provide a slurry carrying ship which is equipped with means for fully draining slurry water and which, by said means, makes it unnecessary to provide upper wing tanks needed to support upper structure, consequently increasing the hold capacity.

To fulfil this object, the present invention provides a slurry carrying ship comprising a plurality of cargo holds for accomodating cargo slurry, each hold being provided with a hatch, wherein characterized that each hold is provided therein with at least one upstanding hollow post disposed beneath the hatch at a location close thereto and providing at least one water passage in its interior space, said post is formed on part of its walls with drainage ports communicating said water passage and provided with filters, and said post is further provided with discharge means communicating said water passage.

With this construction, since the draining post extends through the hold at the central portion thereof (corresponding to the location of the hatch), it can fully drain water from cargo slurry. Further if a plurality of such upstanding posts are provided, they can serve to support the upper structure, so that there is no need to provide upper wing tanks which were conventionally needed to support the upper structure and which inevitably reduced the hold capacity because of their volumes.

According to a preferred embodiment of the present invention, the post is provided with a pressure adjusting pipe for feeding compressed air to the water passage or for sucking air from the water passage. Such an adjusting pipe functions to forcibly aerate cargo slurry for breaking an upper air-impermeable layer formed by fine coal particles and slurry water, consequently enhancing water draining efficiency.

According to another preferred embodiment of the present invention, the post is provided with pressurized water distributing pipe means extending along the water passage and provided with nozzles opening into the exterior space. Dried material, e.g. coal, accomodated in the hold can be returned to a slurry state, for readier unloading, by pressurized water vigorously sprayed from the nozzles.

According to a still further embodiment of the present invention, the interior space of the post is divided by longitudinal partition or partitions to provide a plurality of parallel water passages. With this arrangement, even if one water passage becomes inoperative, the remaining passage or passages can effectively drain slurry water.

These and other numeraous features and effects of the present invention will become apparent from the description of one of the most preferred embodiments given below with reference to the accompanying drawings, in which.

FIGS. 8*a* to 8*e*, inclusive, are views illustrating drainage posts of various cross sections.

Figure 1:
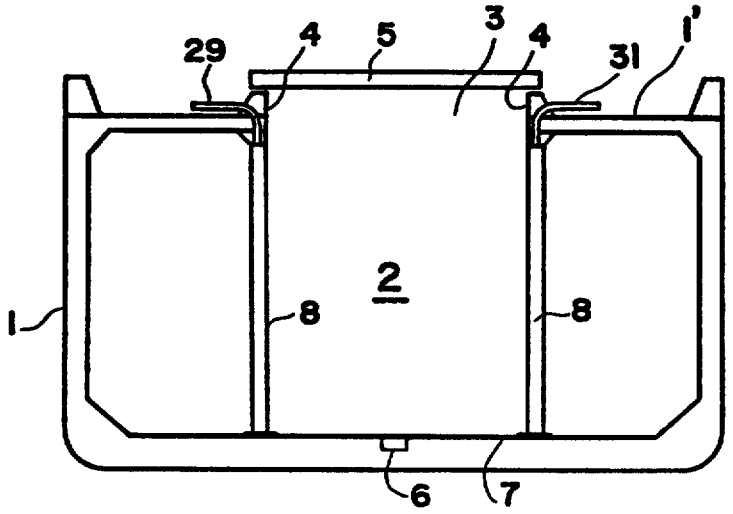
FIG. 1 is a view in transverse section showing a ship according to the present invention.
Figure 2:
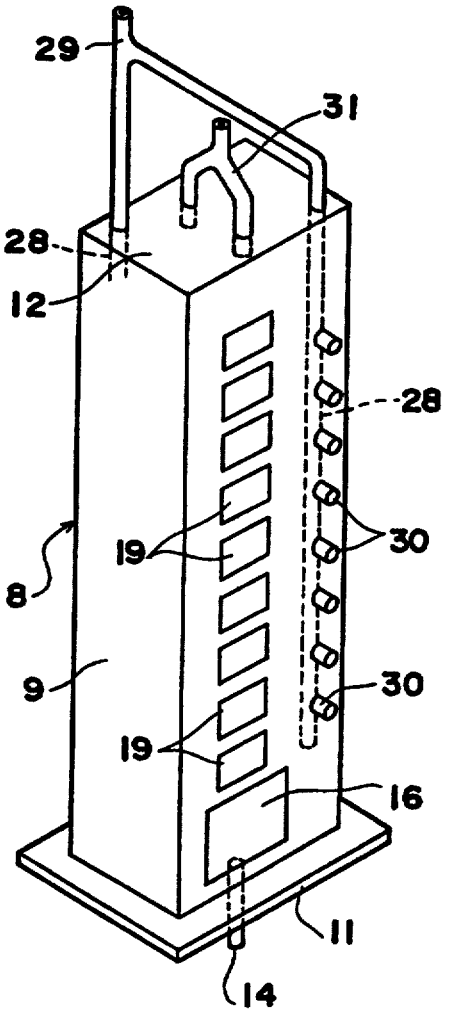
FIG. 2 is a perspective view showing a drainage post.
Figure 3:
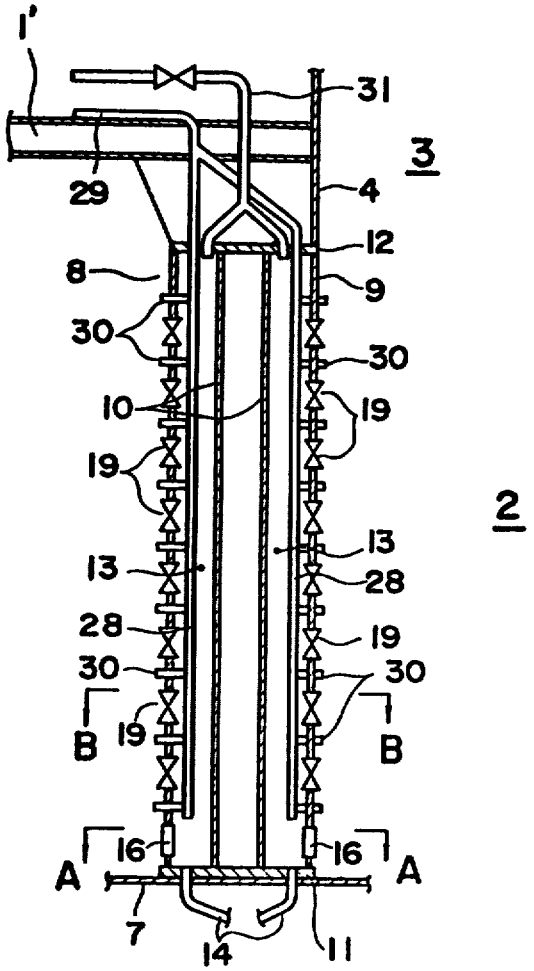
FIG. 3 is a view in longitudinal section showing the same.
Figure 4:
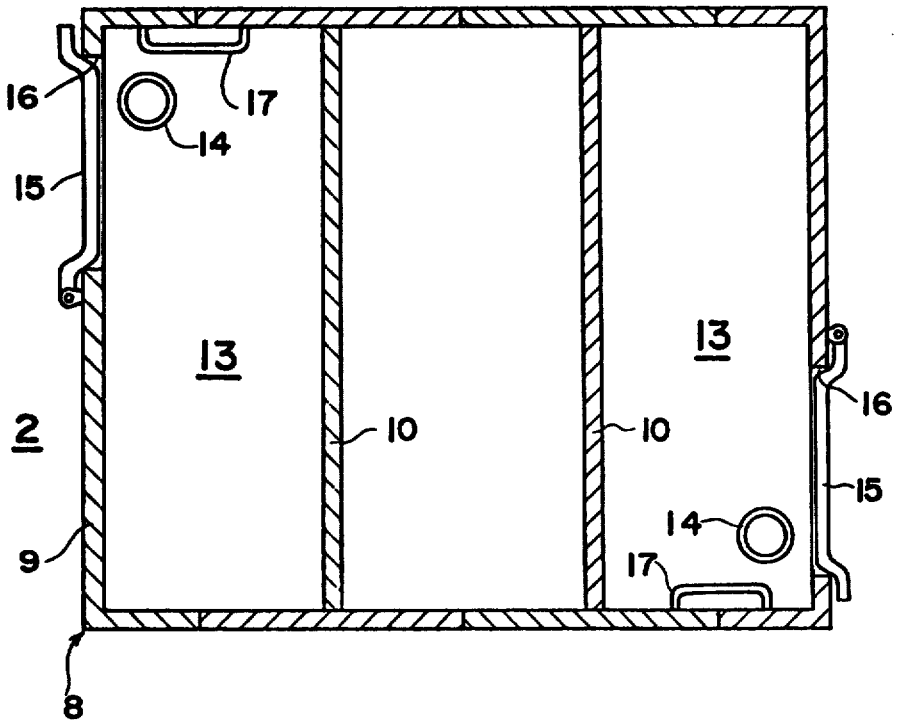
FIG. 4 is a view in section taken on the line A—A of FIG. 3.
Figure 5:
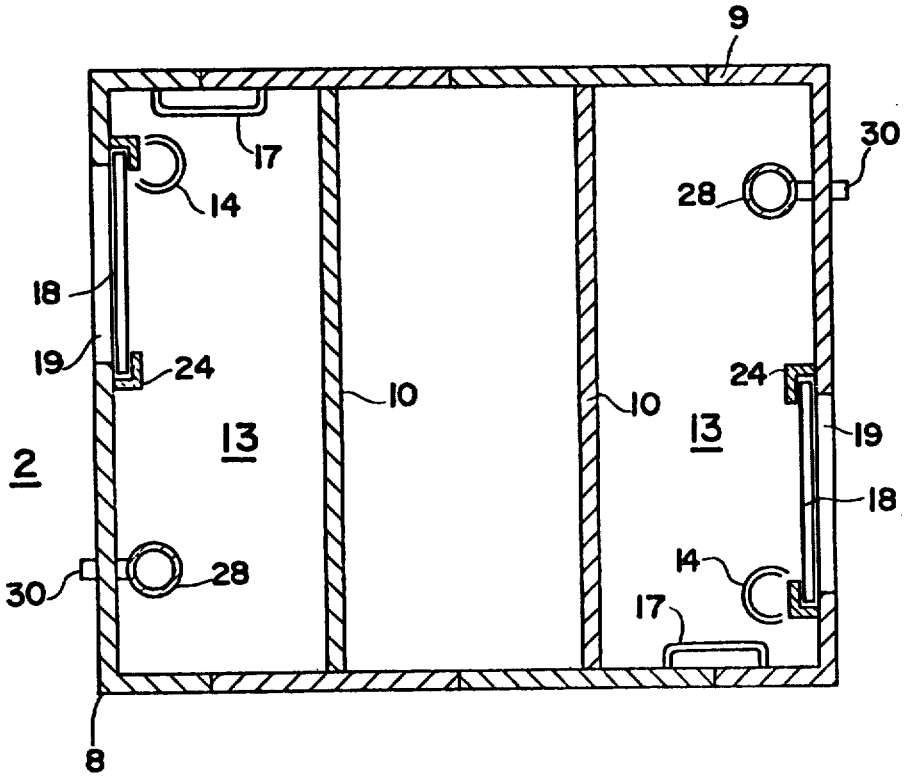
FIG. 5 is a view in section taken on the line B—B of FIG. 3.

Referring to FIG. 1, the hull 1 and deck 1' of a slurry carrying ship define cargo holds 2 in which a load of coal slurry is accomodated. Each hold 2 is accessible through a rectangular hatchway 3 formed by a hatch coaming 4 on the deck 1', and the hatchway 3 is closable by a hatch cover 5. Coal slurry can be drained by a drainage means 6 provided in the bottom wall 7 of the hull 1. That part of the deck 1' providing the hatch 3 is supported by upstanding hollow posts 8 disposed adjacent the four corners of the hatch 3.

As illustrated in FIGS. 2 to 5, each post 8 has a rectangular cross section and comprises side walls 9 defining an interior space, a pair of longitudinal partitions 10 dividing the interior space into three sections, a bottom plate 11 attached to the bottom 7 of the hull 1, and a top plate 12 fixed to the hatch coaming 4. The two side sections of the interior space provide water passages 13 which communicate drain pipes 14 extending through the plate 11 and the wall 7 and provided on their way with valves (not shown). Each of the two opposite side walls 9 facing the passages 13 is provided at its lower end portion with an access opening 16 and an associated door 15 so that an operator can enter the corresponding passage 13 and climb up a ladder 17 provided therein for cleaning, repair and replacement. Each of said two side walls 9 is also formed with a vertical row of drainage ports 19 communicating the corresponding passage 13 and each provided with a filter 18.

Figure 6:
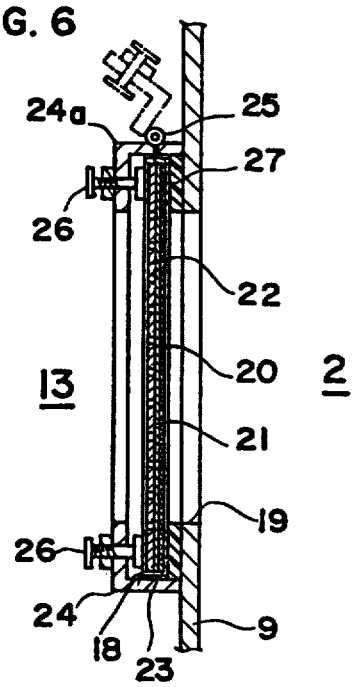
FIG. 6 is a side view in section showing a filter.
Figure 7:
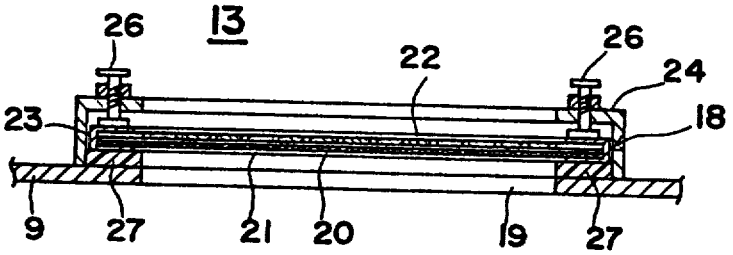
FIG. 7 is a plan view in section showing the same.
Figures 8A, 8B, 8C, 8D, 8E:
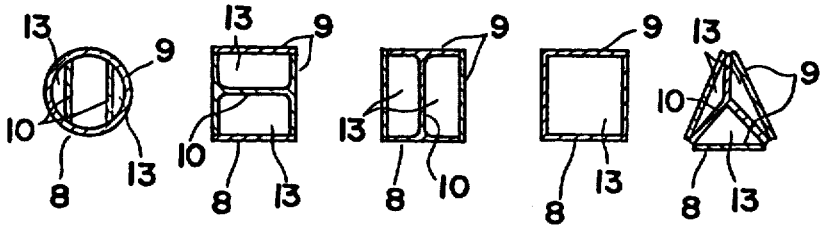

Each filter 18, as shown in FIGS. 6 and 7, consists of a metallic screen filter 20 inside of and close to a corresponding port 19, a fiber filter 21 arranged inwardly of the screen 20, a perforated reinforcing plate 22 disposed inwardly of the fiber 21, and a rubber packing frame 23 for holding the three components together. The filter 18 thus composed can be mounted in a mounting frame 24 attached to the port 19 by inserting it from above with the upper portion 24*a* of the frame 24 turned upward on a hinge 25. A rubber packing 27 is interposed between the filter 18 and the port 19, and the filter 18 is held securely in position against the port 19 by properly operating fastening mebers 26 on the frame 24.

Referring back to FIGS. 2 to 5, distributing pipes 28 are disposed vertically in the respective passages 13 for delivering highly pressurized water, the pipes 28 being connected at the upper ends to a single supply pipe 29. Each distributer 28 is provided with a plurality of lateral nozzles 30 projecting through a corresponding side wall 9. A pressure adjusting pipe 31 is provided above the post 8 in the form of a bifurcated pipe so as to communicate the respective passages 13 for compression or decompression with the supply or suction of air. In operation, a cargo, coal slurry for example, is loaded in a hold 2 through the hatch 3. The slurry water is run off by the drainage means 6 as well as by the drain pipes 14 via the drainage ports 19, the filters 18 and the water passages 13.

The loaded coal slurry contains coal particles of varying sizes, and coal particle of large sizes presipitate faster than those of smaller sizes and settle on the hull bottom 7 while fine particles remain suspended in water in the upper portion of the coal load to form an air-impermeable layer. This layer hampers the passage of air, i.e., water, through the coal load and thus lowers the drainage performance. In order to improve the drainage performance, therefore, it is necessary to break the air-impermeable layer to provide for readier air passage.

According to the present invention, the pressure adjusting pipe 31 delivers compressed air into the passages 13 with the drain pipes 14 closed and pressurizes the chambers 13. The air passes through the filters 18 and enters the hold 2 to forcibly aerate the coal slurry. As a result, the air-impermeable layer is broken and the draining performance enhanced. Alternatively, the pressure adjusting pipe 31 sucks air from the passages 13 for decompression. Consequently, the slurry water is forced to be drawn into the passages 13 with the attendance of aerating the coal slurry by the air trapped in the upper portion of the hold 2. Similarly the air-impermeable layer is effectively broken and the draining performance improved.

The stored coal thus drained is returnable to a slurry state for unloading by supplying pressurized water through the water supply pipe 29 and the distributing pipes 28. More specifically, the pressurized water fed through the distributers 28 vigorously spouts from the nozzles 30 toward the surrounding pile of coal and gradually erodes the coal to effectively bring the coal to a slurry state. The pressurized water sprayed from the nozzles 30 also serves to clean the hold 2.

Each post 8 may have any desired cross section as shown in FIGS. 8*a* to 8*e*, and the number of longitudinal portions 10 is optional. Further any number of draining means may be provided in or on the side walls of the hull 1 for more effective drainage in addition to the bottom drainage means 6 and the drainage posts 8. However, the drainage posts 8 alone can provide sufficient drainage effect because of their locations in the hold 2.

We claim:

1. A slurry carrying ship comprising at least one cargo hold for accommodating cargo slurry, the or each hold being provided with a hatch, wherein the or each hold is provided therein with at least one upstanding hollow post disposed beneath the hatch at a location close thereto and away from side walls defining the hold for supporting a wall in which said hatch is formed, and said post is divided by a longitudinal partition or partitions to provide a plurality of parallel water passages, said post being formed on part of its wall or walls with drainage ports communicating said water passages and provided with filters, said post being further provided with discharge means communicating said water passages.

2. A ship as defined in claim 1, wherein said post is provided with pressure adjusting means for compressing or decompressing said water passages.

3. A ship as defined in claim 2, wherein said pressure adjusting means comprises a pressure adjusting pipe branched off at the upper end of said post for feeding compressed air to said water passages or for sucking air from said water passages.

4. A ship as defined in claim 1, wherein said post is provided therein with pressurized water distributing pipes extending respectively within said water passages therealong and provided with nozzles opening into the exterior hold space.

5. A ship as defined in claim 4 when said pressurized water distributing pipes are connected to a single supply line.

6. A ship as defined in claim 1, wherein said discharge means is provided to communicate said water passages at the lower end of said post.

7. A ship as defined in claim 1 further comprising water drainage means provided on or in the walls defining the hold.

8. A ship as defined in claim 1, wherein each filter comprises a metallic screen filter, a fiber filter and a perforated reinforcing plate as held together by a rubber packing frame.

9. A ship as defined in claim 1, wherein each filter is mounted to a corresponding drainage port by a mounting frame attached to the port and having an opening for communication with the port, said mounting frame having an upper portion hingably openable for insertion of the filter into the frame.

* * * * *